US006532692B2

(12) United States Patent
Cate

(10) Patent No.: US 6,532,692 B2
(45) **Date of Patent: *Mar. 18, 2003**

(54) BREECH PLUG FOR MUZZLE LOADING FIREARM

(75) Inventor: Gordon R. Cate, Stratham, NH (US)

(73) Assignee: Thompson Intellectual Properties, Ltd., Rochester, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/804,453

(22) Filed: Mar. 12, 2001

(65) Prior Publication Data

US 2001/0013191 A1 Aug. 16, 2001

Related U.S. Application Data

(62) Division of application No. 09/334,219, filed on Jun. 16, 1999, now Pat. No. 6,219,951.

(51) Int. Cl.[7] ..... F41C 9/08
(52) U.S. Cl. ..... 42/51
(58) Field of Search ..... 42/51; 89/1.3

(56) References Cited

U.S. PATENT DOCUMENTS

| | | | | | |
|---|---|---|---|---|---|
| 21,802 | A | | 10/1858 | Shenkl | |
| 2,299,086 | A | * | 10/1942 | Garand | 42/51 |
| 4,163,335 | A | | 8/1979 | Ives | |
| 4,186,506 | A | | 2/1980 | Pawlak | |
| 4,227,330 | A | | 10/1980 | Chapin | |
| 4,519,157 | A | | 5/1985 | Giangerelli | |
| 4,888,901 | A | | 12/1989 | French et al. | |
| 5,016,379 | A | | 5/1991 | Lambert | |
| 5,133,143 | A | * | 7/1992 | Knight | 42/51 |
| 5,307,583 | A | | 5/1994 | Mahn et al. | |
| 5,467,551 | A | | 11/1995 | Kruse | |
| 5,632,109 | A | * | 5/1997 | Caudle | 42/51 |
| 5,644,861 | A | | 7/1997 | Knight | |
| 5,678,341 | A | * | 10/1997 | Kahnke | 42/51 |
| 5,706,598 | A | | 1/1998 | Johnston | |
| 5,907,920 | A | | 6/1999 | Laney | |
| 6,219,951 | B1 | * | 4/2001 | Cate | 42/51 |
| 6,226,916 | B1 | * | 5/2001 | Kendall | 42/51 |
| 6,305,113 | B1 | * | 10/2001 | Calvete | 42/51 |

FOREIGN PATENT DOCUMENTS

| | | | | |
|---|---|---|---|---|
| CA | 682317 | * | 3/1964 | 42/51 |
| DE | 2355506 | | 5/1975 | |

* cited by examiner

*Primary Examiner*—Stephen M. Johnson
(74) *Attorney, Agent, or Firm*—Blodgett & Blodgett, P.C.

(57) ABSTRACT

A breech plug assembly for a muzzle loading firearm. The breech plug assembly is screwed into the back opening at the breech end of the barrel of the firearm. The forward end of the conical projection has a tapered or conical projection for supporting the end of a pre-formed explosive pellet.

6 Claims, 5 Drawing Sheets

BREECH PLUG FOR MUZZLE LOADING FIREARM

This application is a divisional of U.S. patent application 09/334,219, filed on Jun. 16, 1999, now U.S. Pat. No. 6,219,951.

CROSS-REFERENCE TO RELATED APPLICATIONS

NOT APPLICABLE

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention relates generally to a breech plug for muzzle loading firearms and particularly for such firearms when using a preformed cylindrical pellet of explosive material which has a central longitudinal bore.

The practice of loading a muzzle loading firearm with black powder in a conventional manner is still popular with traditional muzzle loading enthusiasts. However, the use of preformed cylindrical pellets of explosive material has become increasingly popular. Although the pellets have many advantages, they have limited application. The pellets are recommended for use only with percussion in-line firearms. The pellets are not recommended for use with flintlock and sidelock muzzle loading firearms. The pellets are easy to load and represent a consistent quantity of explosive material. The pellet seats or is supported at the opening of the breech plug of the in-line muzzle loading firearm. Since the opening of the breech plug is not specifically designed for a pellet, there is a tendency for the pellet to be out of axial alignment with the axis of the barrel. If one or more additional pellets are added, these additional pellets will also be out of axial alignment with the longitudinal axis of the barrel. This reduces the consistency of the discharge to some degree. Also, the pellet is not always centered within the breech chamber relative to the longitudinal axis of the barrel. This factor further reduces the consistency of the discharge. These and other difficulties experienced with the use of pre-formed pellets of explosive material have been obviated by the present invention.

It is, therefore, a principal object of the invention to provide a breech plug for muzzle loading firearms which enables pre-formed pellets of explosive material to be used with flintlock, sidelock (caplock), as well as percussion in-line muzzle loading firearms.

A further object of the invention is the provision of a breech plug for a percussion in-line muzzle loading firearm which forms an improved seat or support for pre-formed pellets of explosive material and for maintaining the pellets in axial alignment with the barrel of the firearm.

Another object of the invention is the provision of a breech plug assembly which enables pre-formed pellets to be used with all types of muzzle loading firearms.

With these and other objects in view, as will be apparent tot hose skilled in the art. The invention resides in the combinations of parts set forth in the specification and covered by the claims appended hereto.

BRIEF SUMMARY OF THE INVENTION

In general, the invention consists of a breech plug assembly for a muzzle loading firearm. The breech plug assembly includes a housing which is screwed into the back opening at the breech end of the barrel of the firearm and a plug which is screwed into the rear opening of the housing. The housing contains a chamber for receiving a pre-formed explosive pellet and a fire channel which intersects the chamber. The plug has a tapered forward end for entering the central longitudinal bore of the pellet. The tapered forward end functions as a seat for the pellet to assist in axially aligning the pellet with the central longitudinal axis of the barrel.

The invention also comprises a breech plug assembly for in-line muzzle loading firearms. The breech plug assembly includes a breech plug which is screwed into the rear opening at the breech end of the barrel. The breech plug contains a chamber for receiving a nipple for holding a percussion cap. The breech plug has a tapered forward end for entering the central longitudinal bore of the pellet and for forming a support for the pellet.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
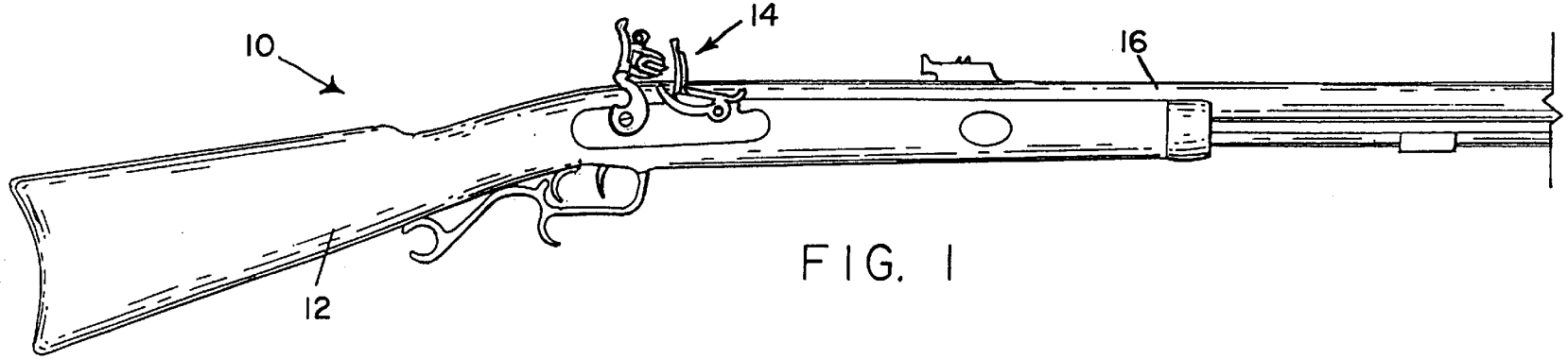
FIG. 1 is a side elevational view of a flintlock muzzle loading firearm to which one form of the present invention is applied.
Figure 2:
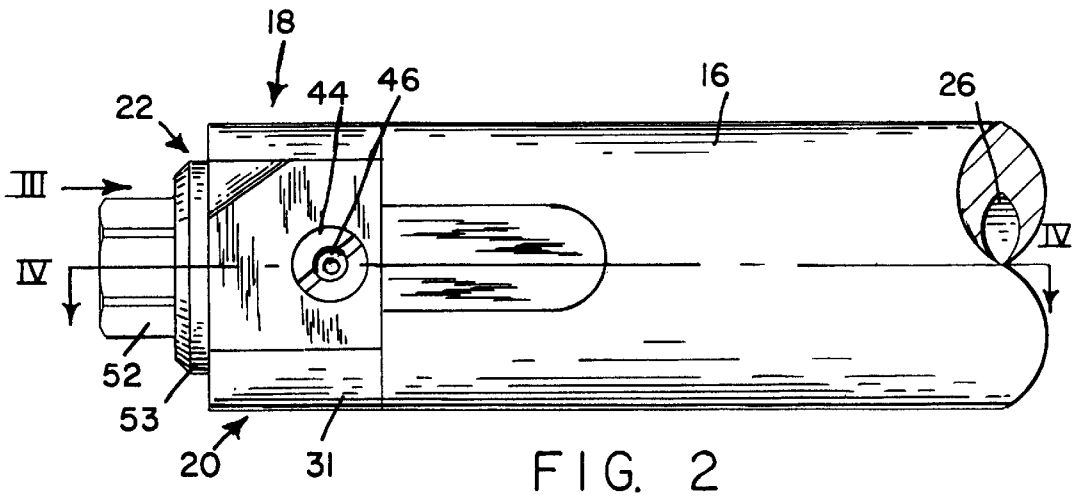
FIG. 2 is a side elevational view of the breech plug assembly of the present invention shown applied to the breech end of the barrel portion of the firearm of FIG. 1 with the flintlock fixtures removed.
Figure 3:
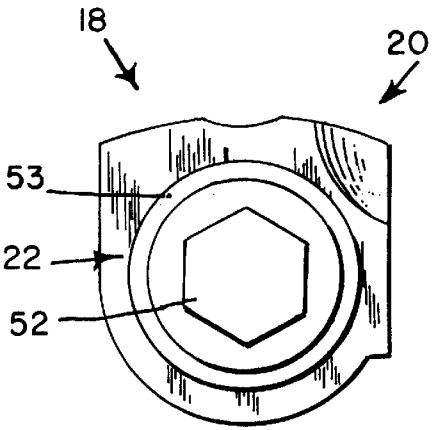
FIG. 3 is an end view of the breech plug assembly of FIG. 2 and looking in the direction of arrow III of FIG. 2.
Figure 4:
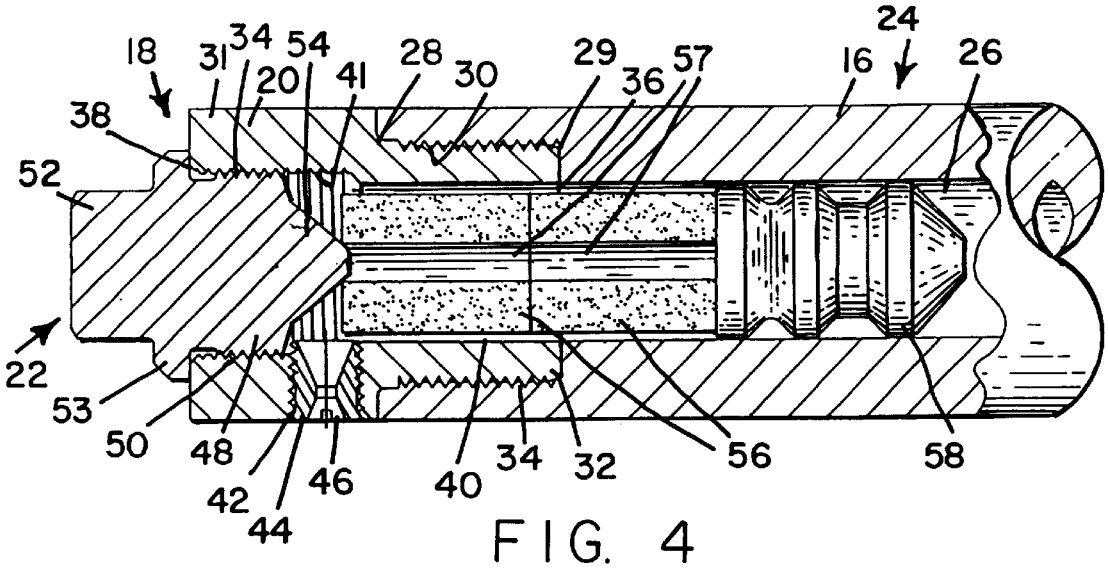
FIG. 4 is a horizontal cross-sectional view of the breech plug assembly and breech end of the barrel, taken along the lines IV—IV of FIG. 2 and looking in the direction of the arrows.
Figure 6:
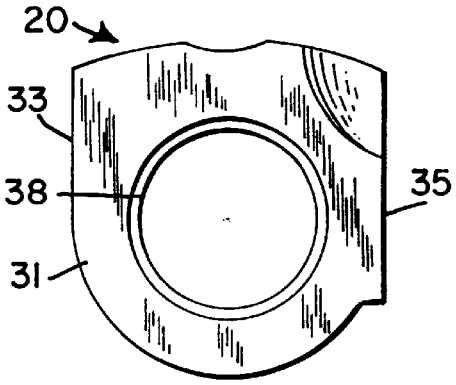
FIG. 6 is an end view of the housing portion, looking in the direction of arrow VI of FIG. 5.
Figure 5:
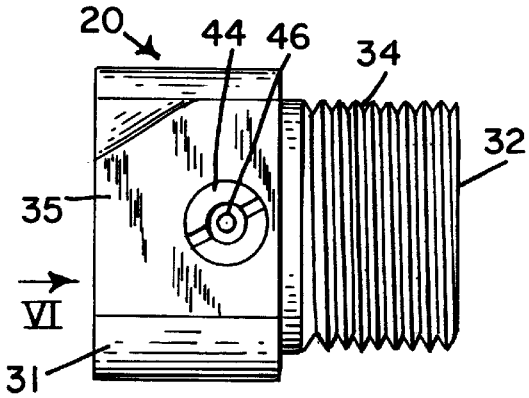
FIG. 5 is a side elevational view of the housing portion of the breech plug assembly of FIG. 2.
Figure 7:
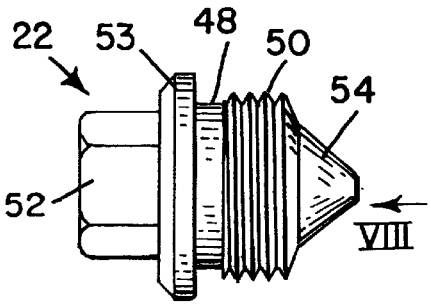
FIG. 7 is a side elevational view of the plug portion of the breech plug assembly of FIG. 2.
Figure 8:
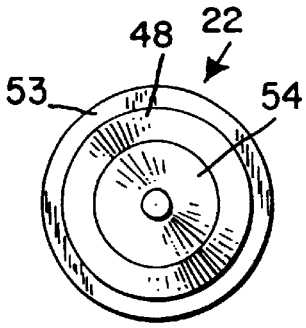
FIG. 8 is an end view of the plug portion, looking in the direction of arrow VIII of FIG. 7.

Referring first to FIGS. 1–3, there is shown a first embodiment of a breech plug assembly, generally indicated by the reference numeral 18, which is adapted for use with a flintlock muzzle loading firearm, as shown in FIG. 1, and generally indicated by the reference numeral 10. The firearm 10 includes a stock 12, a barrel 16, and a flintlock firing mechanism, generally indicated by the reference numeral 14. Referring also to FIG. 4, the barrel 16 has a bore 26. The breech end of the barrel, generally indicated by the reference numeral 24, has a back opening 28 and a counterbore 29 that has internal threads 30. The breech plug assembly 18 comprises a housing generally indicated by the reference numeral 20 and a breech plug, generally indicated by the reference numeral 22.

Referring specifically to FIGS. 2–6, the housing 20 has a relatively large diameter rearward end 31 and a relatively small diameter forward end 32. The forward end 32 has external threads 34 for enabling the forward end of the housing to be screwed into the counterbore 29 of the barrel 16. The housing 20 has a forward opening 36, a rearward opening 38, and a chamber 40 that extends from the forward opening to the rearward opening. The rearward portion of the chamber 40 has internal threads 41. The rearward end 31 of the housing has a threaded aperture 42 for receiving a threaded bushing 44. The bushing 44 has a fire channel or "touch hole" 46 that extends into the chamber 40. The touch hole 46 is aligned with the "flash pan" of the flintlock firing mechanism 14 in a conventional manner. The touch hole 46 extends transversely of the central longitudinal axis of the chamber 40 which is coaxial with the central longitudinal axis of the barrel 16.

Referring specifically to FIGS. 2–4, 7, and 8, the plug 22 has a cylindrical forward end 48 that has external threads 50 and a hexagonal-shaped rearward end 52. An annular stop 53 is located between the rearward end 52 and the forward end 48 for enabling the plug to be inserted at a precise location within the chamber 40 of the housing 20. The external threads 50 enable the plug 22 to be threaded into the rearward portion of the chamber 40, as shown in FIG. 4, and tightened by applying a wrench to the hexagonal-shaped rear portion 52. A conical projection 54 extends forwardly from the cylindrical forward end 48 of the plug so that when the plug 22 is inserted within the chamber 40, the conical projection 54 is aligned with the touch hole 46 as shown in FIG. 4. When the flintlock fixture 14 is properly positioned within the barrel 16, as shown in FIGS. 2 and 4, the flintlock firearm 10 is ready for loading. The flintlock fixture 14 is adapted for use with cylindrical pellets of explosive material for use with a flintlock firearm, such as firearm 10. The pellet is inserted through the muzzle end of the barrel and comes to rest against the projection 56. Two such pellets are shown in FIG. 4 and indicated by the reference numeral 56. Each pellet 56 has cylindrical bore 57. One or more pellets 56 may be used, depending on the type of projectile used and desired muzzle velocity. When the desired number of pellets have been positioned at the breech end of the barrel, a projectile, such as projectile 58, is inserted into the bore 26 from the muzzle end of the barrel so that it rests on the forwardmost pellet 56, as shown in FIG. 4. When the pellets 56 are positioned at the breech end of the barrel, the conical projection 54 of the plug extends slightly into the bore 57 at the rearmost end of the rearmost pellet, as shown in FIG. 4. The projection 54 extends into the bore 57 sufficiently to center the pellet 56 within the chamber 40 and helps to keep the pellets 56 coaxial with the chamber 40 and the bore 26 of the barrel. Also, the projection 54 creates an annular space at the end of the rearmost pellet 56 adjacent the touch hole 46 so that the entire end surface of the pellet is exposed to the ignition spark from the touch hole. The end surface of each pellet 56 is coated with a shallow priming layer of black powder to assist in the ignition of the pellet. The conical projection 54, thereby, helps to direct the ignition spark from the touch hole 46 to this priming surface to ensure proper ignition of the pellet 56.

Figure 9:
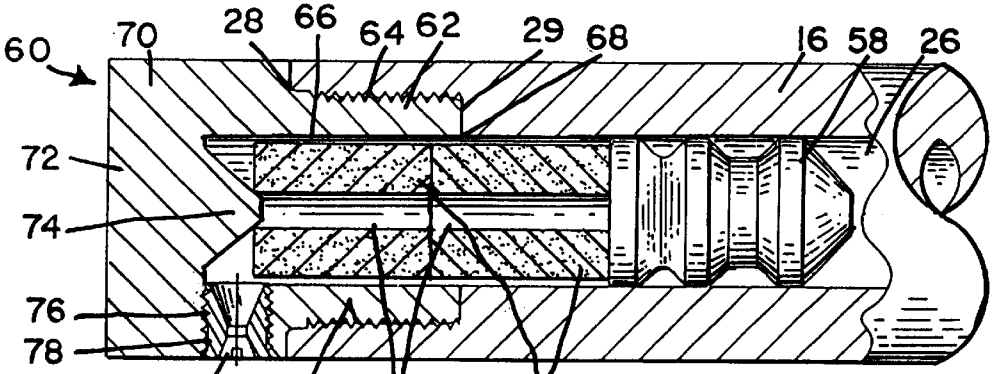
FIG. 9 is a horizontal cross-sectional view similar to FIG. 4 showing a modified breech plug assembly for a flintlock firearm.

Referring to FIG. 9, there is shown a modified breech plug assembly, generally indicated by the reference numeral 60, for use with a flintlock muzzle loading firearm, such as firearm 10. The breech plug assembly 60 is essentially a unitary structure which incorporates the functional features of the housing 20 and the plug 22. The breech plug assembly 60 has a cylindrical forward end 62 that has external threads 64 and a rearward end 70 which has the same external shape as the housing 20 to enable the breech plug assembly 60 to be inserted into the back opening at the breech end of the barrel 16 and tightened with a wrench. The breech plug assembly 60 has a cylindrical chamber 66 which has a forward opening 68. The rearward end 70 of the breech plug 60 has a back wall 72 and a threaded aperture 76 for receiving a threaded bushing 78. The bushing 78 contains a fire channel or "touch hole" 80 which extends into the chamber 66. A conical projection 74 extends forwardly from the back wall 72 into the chamber 66 so that the projection 74 is in alignment with the touch hole 80. When a pellet 56 is positioned within the chamber 66, the conical projection 74 extends slightly into the bore 57 of the pellet in the same manner and for the same purpose for the projection 54 of the breech plug assembly 18.

Figure 10:
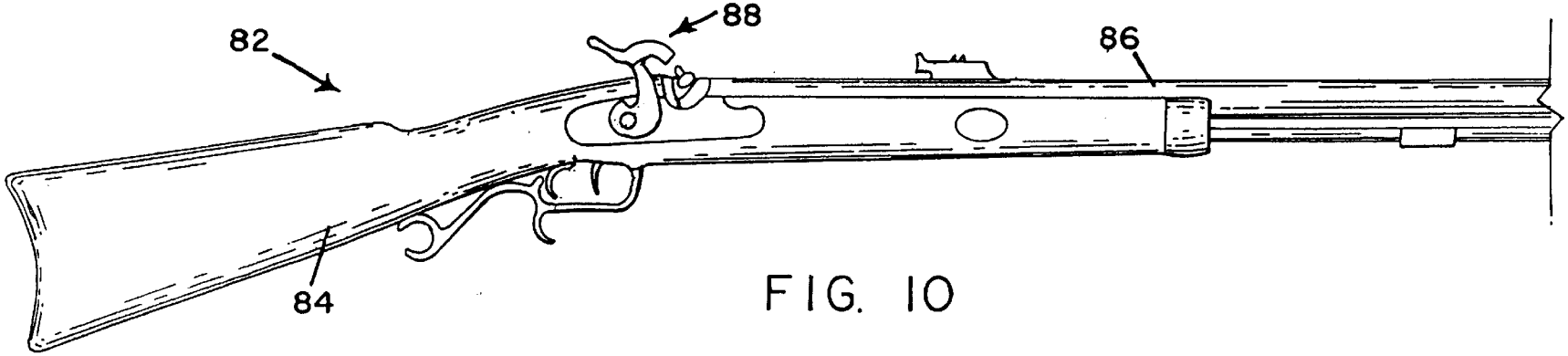
FIG. 10 is a side elevational view of a sidelock muzzle loading firearm to which a third embodiment of the present invention is applied.
Figure 11:
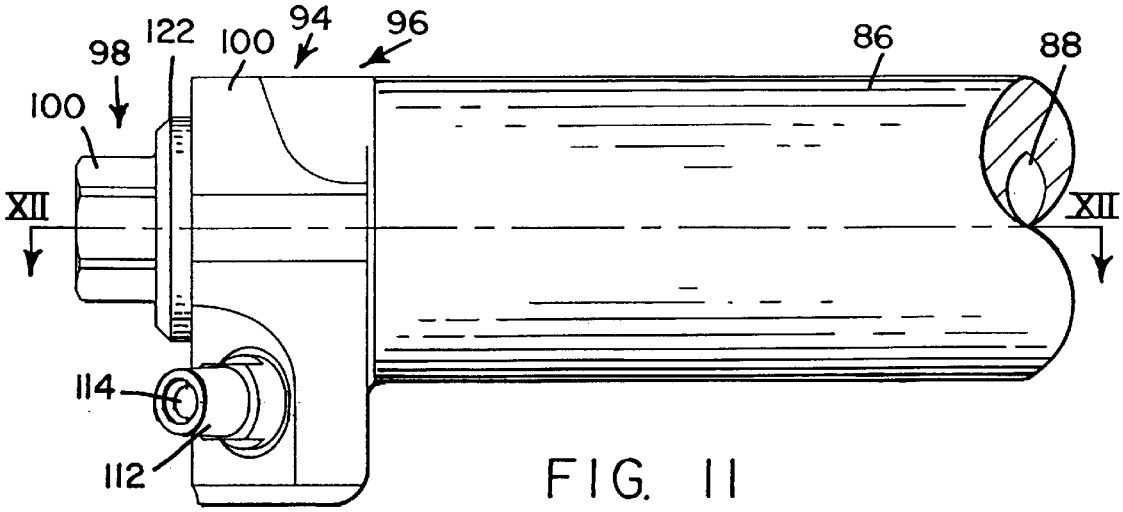
FIG. 11 is a plan view of a modified breech plug assembly for use with the sidelock muzzle loading firearm of FIG. 10 and shown applied to the breech end of the barrel.
Figure 12:
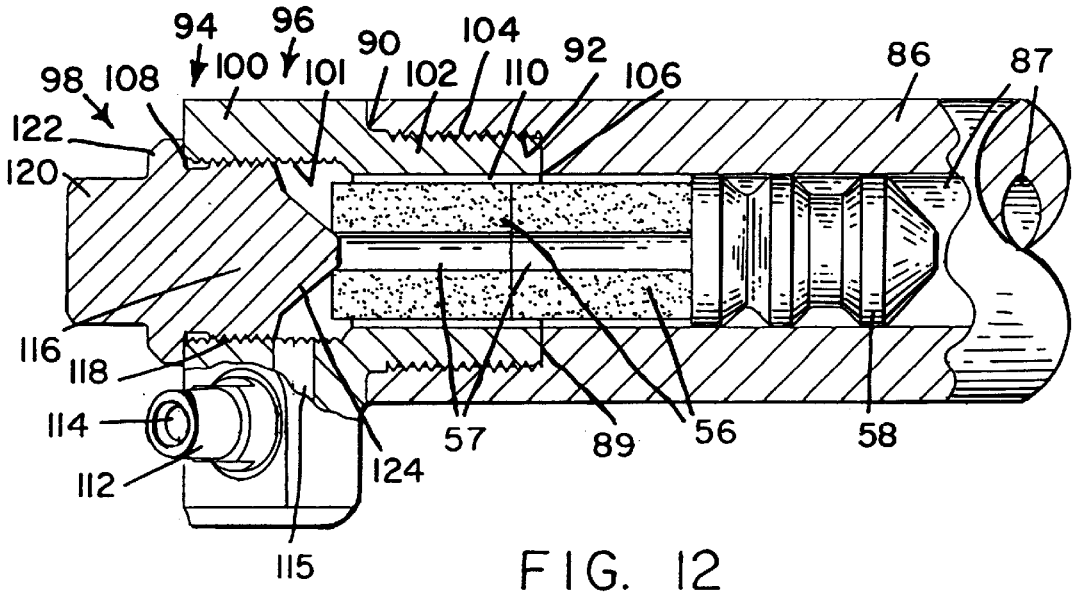
FIG. 12 is a horizontal cross-sectional view taken along line XII—XII of FIG. 11 and looking in the direction of the arrows.

Referring to FIGS. 10–12, there is shown a breech plug assembly, generally indicated by the reference numeral 94, which embodies the principals of the present invention and is adapted for use with a sidelock muzzle loading firearm, such as that shown in FIG. 10, and generally indicated by the reference numeral 82. Firearm 82 includes a stock 84, a barrel 86, a sidelock (caplock) mechanism, generally indicated by the reference numeral 88. The barrel 86 has a bore 87 and a counterbore 89 at the breech end of the barrel. The counterbore 89 has internal threads 92 and a back opening 90.

The breech plug assembly 94 includes a housing, generally indicated by the reference numeral 96, and a plug, generally indicated by the reference numeral 98. The housing 96 has a relatively large diameter rearward end 100 and a relatively small diameter forward end 102 which has external threads 104 for enabling the housing 96 to be threaded into the counterbore 89. The housing 96 has a cylindrical chamber 110 that has internal threads 101 at the rearward end 100. The chamber 110 has a forward opening 106 and a rearward opening 108. The housing 96 has a sidelock (caplock) fixture 112 which forms part of the sidelock firearm mechanism 88 and which contains a fire channel 114. The housing 96 contains a fire channel 115 which is connected to the fire channel 114 and to the chamber 110. The fire channel 115 extends transversely of the central longitudinal axis of the chamber 110 and the bore 87 of the barrel 86.

The plug 98 has a cylindrical forward end 116 and a hexagonal-shaped rearward end 120. The forward end 116 has external threads 118 for enabling the plug 98 to be threaded into the rearward portion of the chamber 110. The plug 98 has an annular stop 112 between the rearward end 120 and the forward 116 for enabling the plug 98 to be located at a precise position within the chamber 110. A conical projection 124 extends forwardly from the forward end 116 of the plug so that when the plug 98 is inserted into the chamber 110 the projection 124 is aligned with the fire channel 115, as shown in FIG. 12. When a pellet 56 is inserted into the chamber 110, the conical projection 124 extends into the bore 57 of the pellet in the same manner for the same purpose as for the embodiment shown in FIGS. 4 and 9. If desired, the breech plug assembly 94 can be made as a single integral unit to form a unitary breech plug in the same manner as for the breech plug 60. However, the two piece breech plug assembly consisting of a housing and plug is preferred for both the flintlock and the side lock firearms for ease of manufacturing and for ease in cleaning of the barrel.

Figure 13:
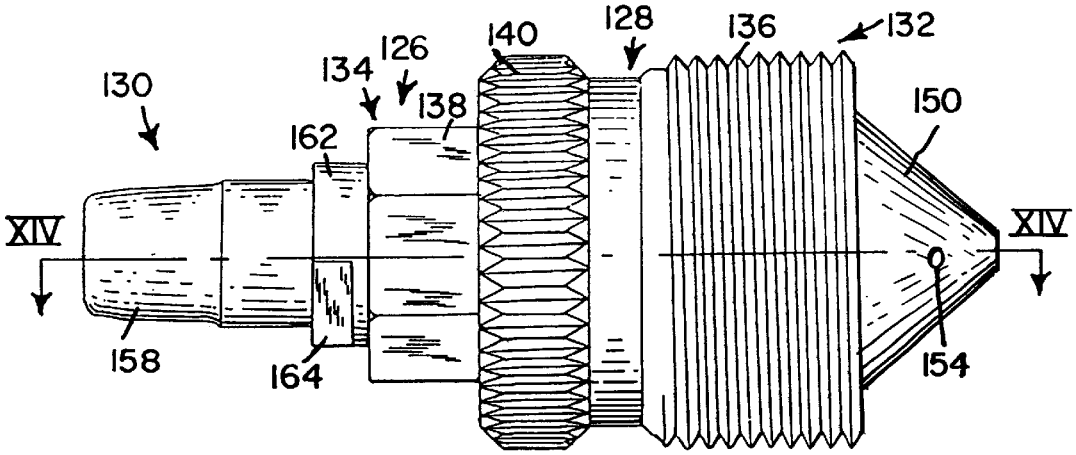
FIG. 13 is a side elevational view of a breech plug assembly embodying the principles of the present invention and adapted for use with a percussion in-line muzzle loading firearm.
Figure 14:
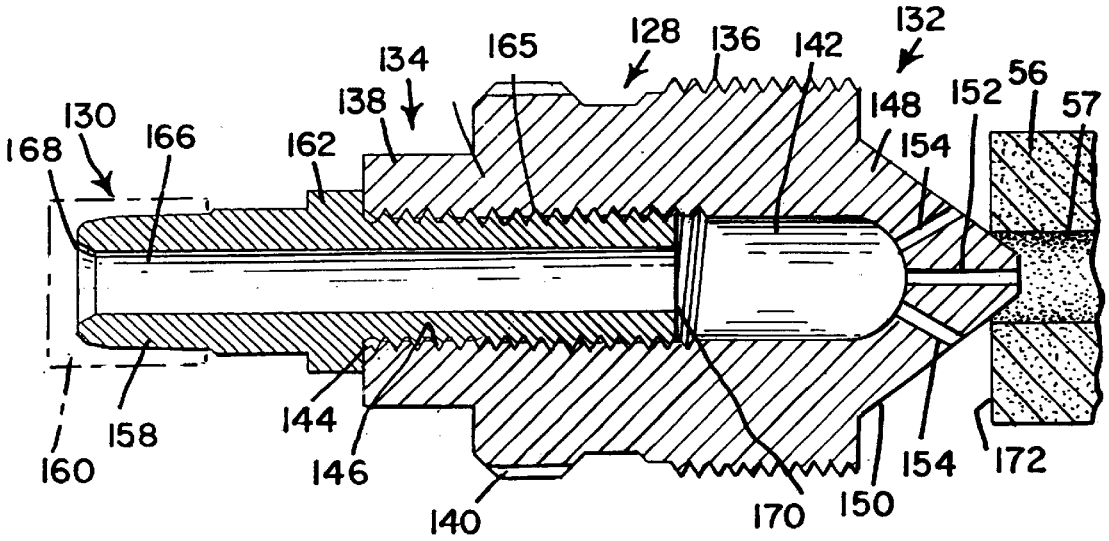
FIG. 14 is a horizontal cross-sectional view taken along line XIV of FIG. 13 and looking in the direction of the arrows.
Figure 15:
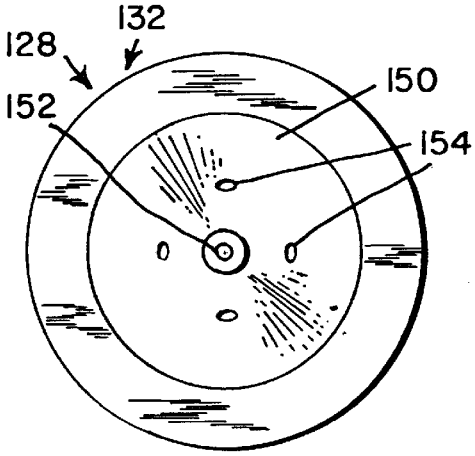
FIG. 15 is a front elevational view of the breech plug assembly of FIG. 13.

Referring to FIGS. 13–15, there is shown a breech plug assembly, generally indicated by the reference numeral 126 which embodies the principals of the present invention and is adapted for use with an in-line cap lock muzzle loading firearm. Breech plug assembly 126 includes a breech plug, generally indicated by the reference numeral 128, and a percussion nipple, generally indicated by the reference numeral 130.

The breech plug 128 has a forward end, generally indicated by the reference numeral 132, and rearward end, generally indicated by the reference numeral 134. The forward end 132 of breech plug 128 has external threads 136 which mate with corresponding internal threads in a rearward counter bore at the breech end of the barrel of an in-line muzzle loading firearm. The rearward end 134 of the breech plug has a hexagonal fixture 138 and a knurled surface 140 for enabling the breech plug to be inserted into the breech end of the barrel. The fixture 138 is adapted to receive a wrench and the knurled annular surface 140 is adapted for enabling the plug to be removed by hand after it has been loosened with wrench or for inserting the plug by hand into the breech end of the barrel and then tightening the breech plug with a wrench.

The percussion nipple 130 has a forward end, generally indicated by the reference numeral 156, a rearward end 158 for receiving a percussion cap 160, shown in dotted lines, and a fixture 162 located between the rearward end 158 and the forward end 156. The fixture 162 has a pair of opposed flat areas 164 for receiving a wrench for tightening the nipple 130 when it is inserted into the breech plug 128. The forward end 156 of the nipple 130 has external threads 165 for enabling the nipple to be screwed into the chamber 142 of the breech plug 128. The nipple 130 contains a rearward fire channel 166 which extends from a rearward opening 168 to a forward opening 170.

The breech plug 128 has a cylindrical chamber 142 that has a rear opening 144. The rearward portion of the chamber 142 has internal threads 146. The forward end of the breech plug 128 has a forward wall 148 that has a outer conical surface 150. The forward wall 148 has a forward fire channel 152 which extends entirely through the wall 148 from the chamber 142. The forward fire channel 152 is coaxial with the chamber 142 and with the bore of the rifle barrel. The forward wall 148 also contains a plurality of supplementary fire channels 154 which extend from the chamber 142 entirely through the forward wall 148. The supplementary fire channels 154 extend at an acute angle to the forward fire channel 152. When a pellet 56 is positioned within the breech end of the bore of the barrel, the conical surface 150 extends into the bore 57 of the pellet, as shown in FIG. 14. Therefore, the forward fire channel extends directly from the chamber 142 into the bore 57 of the pellet while the supplementary fire channels 154 extend from the chamber 142 to the end primary surface 172 of the pellet 56. The end surface 172 of the pellet 56 is primed with a thin layer of black powder to assist in the ignition of the pellet 56.

With the breech plug assembly 126 operatively connected to the be breech of a muzzleloading firearm of the in-line caplock type, the firearm is discharged by attaching a percussion nipple 160 to the rearward end 158 of the nipple. When the hammer of the firearm is released, it strikes the percussion cap 160, thereby discharging the same, and causing a discharge of burning gas to enter the rearward fire channel 166. The burning gas from the rearward fire channel 166 enters the chamber 142 and then passes through the forward fire channel 152 and the supplementary fire channels 154. Burning gas from the percussion cap, thereby, enters the bore 57 of the pellet as well as being directed against the priming surface 172 of the pellet.

What is claimed is:

1. A breech plug assembly for a muzzle loading firearm having a barrel, said barrel having a muzzle end, a breech end, a front opening at said muzzle end, a back opening at said breech end and a bore extending along a central longitudinal axis from said front opening to said back opening, said bore having internal threads adjacent said back opening, said breech plug assembly comprising:

(a) a housing having a rearward end and a forward end which has external threads, said housing having a forward opening at said forward end, a rearward opening at said rearward end, a chamber extending from said forward opening to said rearward opening, and a fire channel connected to said chamber, said chamber having internal threads adjacent said rearward opening, the portion of said chamber adjacent said forward opening constituting a powder well; and (b) a plug having a cylindrical forward end with external threads for screwing into said chamber, a rearward end adapted for being gripped for inserting said plug into said housing and for removing said plug from said housing, and a projection which tapers inwardly toward the forward end of said housing and extends into the powder well portion of said chamber.

2. A breech plug assembly as recited in claim 1, wherein the rearward end of said plug is a nut.

3. A breech plug assembly as recited in claim 1, wherein said projection is conical.

4. A breech plug assembly as recited in claim 1, wherein said plug further comprises an annular stop between said rearward end and the forward end of said plug for enabling said plug to be located precisely within the chamber of said housing.

5. A breech plug assembly as recited in claim 1, wherein said fire channel extends transversely of said chamber and said housing includes a cap lock fixture connected to said fire channel.

6. A breech plug assembly as recited in claim 1, wherein said fire channel is a touch hole which extends transversely from said chamber.

* * * * *